United States Patent [19]

Smulders

[11] 4,145,987

[45] Mar. 27, 1979

[54] FLARE BUOY

[75] Inventor: Louis H. M. Smulders, Houston, Tex.

[73] Assignee: Single Buoy Moorings Inc., Fribourg, Switzerland

[21] Appl. No.: 755,016

[22] Filed: Dec. 28, 1976

[30] Foreign Application Priority Data

Sep. 20, 1976 [NL] Netherlands ..... 7610435

[51] Int. Cl.[2] ..... B63B 21/00

[52] U.S. Cl. ..... 114/230; 9/8.3 R; 431/202

[58] Field of Search ..... 9/8 R, 8 P, 8.3 R; 114/230, 250, 264, 294; 431/202

[56] References Cited

U.S. PATENT DOCUMENTS

| | | | |
|---|---|---|---|
| 3,442,245 | 5/1969 | Christians et al. | 114/230 |
| 3,668,875 | 6/1972 | Sander et al. | 114/230 |
| 3,685,479 | 8/1972 | Bruce | 114/294 |
| 3,726,247 | 4/1973 | Dalzell | 114/230 X |
| 4,029,039 | 6/1977 | Heijst | 9/8 P X |

*Primary Examiner*—Trygve M. Blix
*Assistant Examiner*—Sherman D. Basinger
*Attorney, Agent, or Firm*—Young & Thompson

[57] ABSTRACT

A flare buoy for burning off excess hydrocarbon gas during the offshore production or processing of hydrocarbons, comprises a submerged buoyant body that extends upwardly past the water in a portion of reduced cross-sectional area and terminates upwardly in a flare conduit which receives gaseous hydrocarbon from a tanker or other buoyant structure. The flare buoy is rigidly connected to an arm which at its end remote from the flare buoy is pivotally connected to the tanker. The arm is in two parts that diverge from the flare buoy and are pivotally connected to the side of the tanker.

4 Claims, 2 Drawing Figures

FLARE BUOY

This invention relates to a flare buoy comprising a buoyant body including a flare conduit, which by means of a tube and/or hose is connected to a buoyant structure anchored to the sea bottom, which structure may for example be a tanker anchored to a mooring buoy.

Such a flare buoy is known per se.

The production and processing of liquid or gaseous hydrocarbons yields gases which are conveyed to be combusted at a safe distance. Buoyant structures which are anchored to the sea bottom will have insufficient stability to permit the provision of an elevated flare conduit or tower and the associated flare ducting; more particularly this holds true for a processing or storage tanker of the kind anchored to a mooring buoy. The movements resulting from wave actions impose substantial accelerative forces which act upon the elevated flare conduit.

It is known to discharge the waste gases to an underwater pipeline by way of the mooring buoy and to convey the same to surface equipment, to a platform or to a separate flare buoy anchored at a remote location with respect to the buoyant structure so as to combust the said gases. This arrangement is expensive and more or less dangerous for navigation due to the substantial distance between the structure and the flare buoy, especially so if the paths of the tankers to be loaded or unloaded approach the flare buoy. The latter might occur for buoyant structures consisting of tankers which are anchored to a mooring buoy due to the fact that they orbit about the mooring buoy in response to the action of wind and water.

The object of the invention is to overcome the above difficulties.

According to the invention, this object is accomplished by interconnecting the flare buoy and the buoyant structure by means of a rigid beam pivotally connected to the latter. Thus the spacing between the flare buoy and the structure will be constant regardless of the orientation of the latter, i.e. so that the buoy will move in unison with a tanker orbiting about a mooring buoy to which it is anchored. The hull face of the buoyant structure opposite to the flare buoy will thus be available for mooring tankers.

According to preferred features of the invention the interconnecting ducts are short. The flare buoy may consist of a substantially submerged buoyant body a small diameter portion of which intersects the water level. The inherent stability of the novel flare buoy is small, so that it can be provided with an arm which is rigidly connected to the same according to a further feature of the invention, i.e. so that the flare conduit may be supported by a relatively small buoy. In another embodiment a buoy may be used which is substantially located at the water level, and which is provided with multiple joints such as universal or spherical joints for interconnecting the arm with the flare buoy and with the buoyant structure. For flare buoys provided with an arm rigidly connected thereto the arm may be connected to the buoyant structure by means of a single joint.

It is possible to interconnect the arm and the buoyant structure by means of a spherical joint, and to properly locate the arm by means of guy ropes or the like.

The arm may be located above the water level as well as therebelow, preferably however above the water level to minimize the influence of wave action. Such minimization is still possible if the arm is located below the water level; but in that case, inspection of the gas ducting may prove to be difficult.

The arm is preferably connected at the roll axis of the floating structure, e.g. of a tanker, or substantially so.

Seen in plan view the arm consists of two elements diverging toward the floating structure.

For floating structures moored according to the method described in Dutch application No. 7208003, and comprising apparatus having a large stability for roll instead of a tanker, the mooring buoy may also provide the flare buoy.

The invention will now be more fully described with reference to the accompanying drawing, in which.

Figure 1:
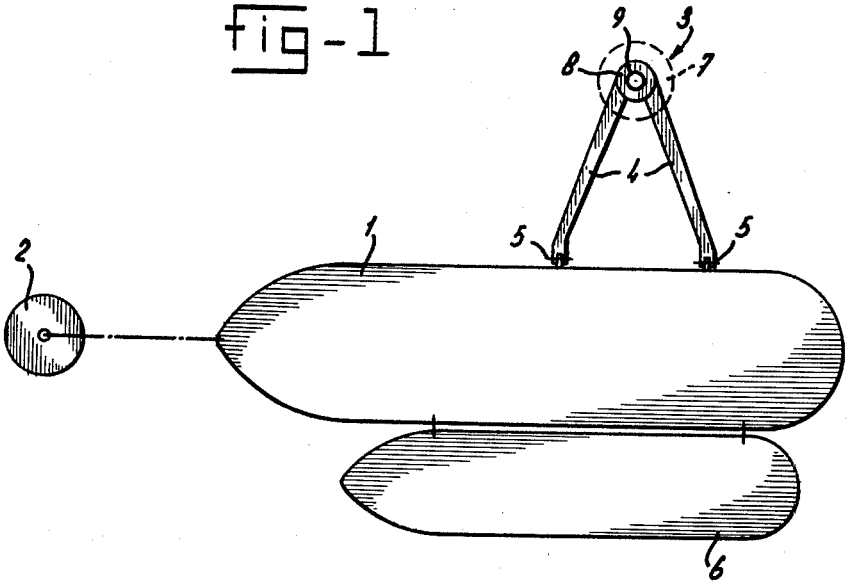
FIG. 1 is a diagrammatic plan view of the invention.
Figure 2:
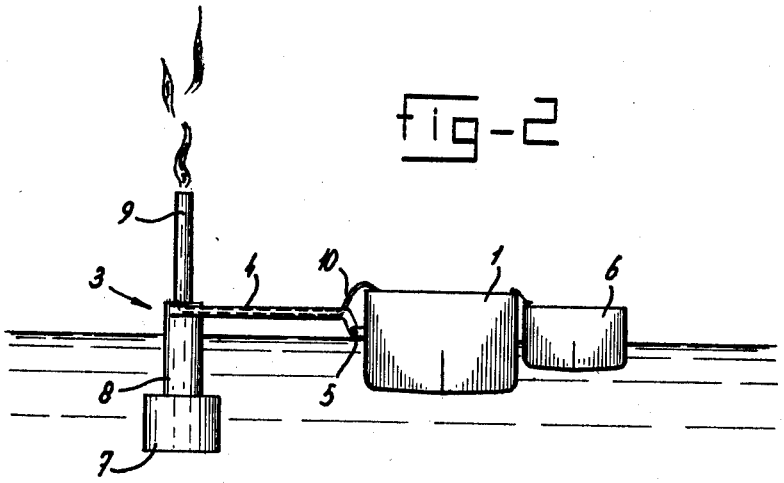
FIG. 2 is a rear elevational view thereof.

FIG. 1 shows a storage tanker 1 anchored to a mooring buoy 2 in turn anchored to the sea bottom by known means (not shown). The tanker 1 is connected to the mooring buoy 2 in such a way that it can orbit about the buoy through a substantial angle, usually for a full 360°.

A flare buoy 3 is connected to one side of the tanker 1 by means of two arms 4. The arms are rigidly connected to the flare buoy, and they are connected to the tanker 1 for vertically swinging movement about a horizontally extending pivotal axis 5.

A tanker 6 may be temporarily anchored or moored to the other side of the storage tanker 1 so as to permit supply or delivery of products.

The flare buoy comprises, at least in the embodiment shown, a submerged buoyant section 7 and a column 8 which intersects the water level and which supports the flare conduit 9. The latter is connected to the storage tanker 1 by means of ducting 10 by which flammable hydrocarbon gases are conveyed from tanker 1.

The arms 4 may be connected to the storage tanker by means of other pivotal devices. For flare buoys having a buoyant structure with a substantial inherent stability but subjected to substantial movements due to the action of the waves, it is preferred to connect the arm to the buoy by means of joints with two or three pivotal axes.

Embodiments of the buoyant structure may be designed in such a way as to have a reduced rolling angle so that the mooring buoy and the flare buoy may be integrated into a single structure.

What is claimed is:

1. Mooring arrangement comprising a mooring buoy (2), a buoyant structure (1) connected to said mooring buoy, a flare buoy (3), a rigid arm (4) which has a rigid connection with the flare buoy (3), means mounting said rigid arm for vertical swinging movement on and relative to said buoyant structure (1) about a horizontal axis, said flate buoy (3) being connected only with said buoyant structure (1).

2. A flare buoy as claimed in claim 1, said arm (4) being pivotally interconnected at its end to a side of said buoyant structure (1).

3. A flare buoy as claimed in claim 1, in which said buoy (2) comprises a substantially submerged buoyant body (7) and a portion (8) extending upwardly from said body and intersecting the water line, said upwardly extending portion at said water line having a substantially smaller cross-sectional area than said submerged buoyant body.

4. A flare buoy as claimed in claim 1, said arm (4) being disposed above the water level.

* * * * *